US007281275B2

(12) United States Patent
Bitzer

(10) Patent No.: US 7,281,275 B2
(45) Date of Patent: Oct. 16, 2007

(54) GLOVE WITH IMPROVED COMFORT AND METHOD OF MAKING SAME

(76) Inventor: Robert Bitzer, 950 Enchanted Way, Suite 104, Simi Valley, CA (US) 93065

( * ) Notice: Subject to any disclaimer, the term of this patent is extended or adjusted under 35 U.S.C. 154(b) by 186 days.

(21) Appl. No.: 11/245,143

(22) Filed: Oct. 5, 2005

(65) Prior Publication Data

US 2007/0074331 A1 Apr. 5, 2007

(51) Int. Cl.
*A41D 19/00* (2006.01)

(52) U.S. Cl. ..... 2/163; 2/161.6; 2/169

(58) Field of Classification Search ..... 2/161.6, 2/163, 169

See application file for complete search history.

(56) References Cited

U.S. PATENT DOCUMENTS

| | | | | |
|---|---|---|---|---|
| 1,358,823 | A | 11/1920 | Burden | |
| 1,494,087 | A * | 5/1924 | Werle | 81/134 |
| 1,525,224 | A | 2/1925 | Charney | |
| 1,540,718 | A | 6/1925 | Sturm | |
| 1,620,643 | A | 3/1927 | Gillian | |
| 2,125,673 | A * | 8/1938 | Geissmann | 2/159 |
| 2,386,688 | A * | 10/1945 | Julianelli et al. | 2/169 |
| 2,538,837 | A | 1/1951 | Johnston | |
| 2,742,645 | A * | 4/1956 | Bleeth | 2/169 |
| 3,111,678 | A * | 11/1963 | Slimovitz | 2/163 |
| 4,245,357 | A | 1/1981 | Connelly | |
| 4,507,807 | A | 4/1985 | Karkanen | |
| 4,654,896 | A | 4/1987 | Rinehart | |
| 4,751,750 | A | 6/1988 | Tepley | |
| 4,766,612 | A | 8/1988 | Patton, Sr. | |
| 4,850,053 | A | 7/1989 | Tepley et al. | |
| 5,581,809 | A | 12/1996 | Mah | |
| 5,815,839 | A | 10/1998 | Safford | |
| 6,029,276 | A | 2/2000 | White | |
| 6,098,200 | A | 8/2000 | Minkow et al. | |
| 6,289,517 | B1 | 9/2001 | Minkow et al. | |
| 6,651,255 | B1 | 11/2003 | Schild | |

* cited by examiner

*Primary Examiner*—Katherine Moran
(74) *Attorney, Agent, or Firm*—Law Offices of David L. Hoffman

(57) ABSTRACT

A glove has a palm portion, a front ring finger portion unitary therewith, and a first sidewall thereof, a back portion fixed to the palm portion, a back pinky portion, a back ring finger portion, a separate pinky portion formed of a separate material from the palm portion and back portion, and fixed to the palm portion and back pinky portion. The glove also has a thumb portion, a pointer finger portion, and a middle finger portion. This construction enables the first sidewall of the ring finger portion and inner sidewall of the pinky portion to be made unitary. A method of making the glove includes cutting the front of the glove with a palm portion that includes a front ring finger portion and first sidewall as one piece of material, cutting from a separate piece of material the front portion of the pinky finger portion so that it includes an inner sidewall, and sewing the front palm portion, back portion, and front ring finger portion to the palm and back portions.

20 Claims, 7 Drawing Sheets

GLOVE WITH IMPROVED COMFORT AND METHOD OF MAKING SAME

BACKGROUND OF THE INVENTION

1. Field of the Invention

The present invention relates to gloves and a method of making same, and in particular to gloves with improved comfort.

2. Description of the Related Art

In horse riding, the rider typically wears gloves to hold the reins. The reins pass between the first finger (thumb) and second (pointer or index) finger, and also between the fourth (ring) finger and fifth (pinky) finger. Accordingly, conventional riding gloves often have reinforcing sewn on the fourth and fifth fingers, and on the second finger. While such reinforcing may help provide wear resistance and some comfort, it does not make the glove comfortable on the hand of the wearer.

In typical glove construction, there are seams on the inside where the front and back halves of the gloves are sewn together. The present inventor has recognized the problem that the rider will feel the seams of the pinky and ring fingers rubbing on the rider's fingers whether reinforcing is provided on the outside or not. This rubbing is exacerbated by pressure from holding the reins and can irritate the rider.

The problem is that in order to make a glove, there must be a seam on the finger portion otherwise bending a finger will create a lot of pressure on the tip of the finger. Because the reins are held with fingers bent, such pressure would be unacceptable.

Conventionally, two pieces of material, front and back, are sewn together to form the hand and finger portions for a smoother better finger construction. The front for all four fingers are cut from same piece of material as palm, as is the back for the fingers and back of the hand. There is also a sidewall seam on the pinky and ring fingers. Additional pieces of material are used to form sidewalls for the pointer, ring and middle fingers.

However, there are many variations of making gloves. For example, in U.S. Pat. No. 1,358,823 to Burden, there is a glove with the hand portion and lower portions of the fingers made in one piece, and most of the finger portions made in separate pieces, so that the fingers can be made of a warmer material than the rest of the glove.

U.S. Pat. No. 5,815,839 to Safford discloses a glove, designed for use by bicyclists, which has a front panel of wear-resistant material, a somewhat thinner panel of wear-resistant material, and a rear panel of open weave net material. Elongated finger sections of the second panel have sinuous side edges that promote flexibility of the glove finger sections. Resilient pads on rear surfaces of the finger sections provide protection against cuts and bruises.

U.S. Pat. No. 4,850,053 to Tepley discloses a glove having a palm piece including a thumb portion, a first finger portion and a fourth finger portion, and a straight linear cut connecting the base of the first finger portion and the fourth finger portion at an angle of between about 13 and 19 degrees to a line parallel to a longitudinal axis of the thumb portion, a back thumb piece, a back piece including first, second, third, and fourth back finger portions, and second and third finger pieces are attached together to provide a glove particularly conformed to the shape of the working hand, the hand in action, and the hand as it is naturally meant to be used.

U.S. Pat. No. 4,751,750 to Tepley discloses a glove having a palm piece including a thumb portion with a longitudinal axis extending substantially parallel to a lower edge of the glove, a first finger portion and a fourth finger portion, and a straight linear cut connecting the base of the first finger portion and the fourth finger portion at an angle of between about 21 to 25 degree to a line parallel to the lower edge of the glove, as in the other Tepley patent.

U.S. Pat. No. 6,651,255 to Schild discloses a glove having a pinky finger, ring finger, middle finger, index finger and thumb receiving portion in communication with a hand receiving portion. The pinky finger, ring finger, middle finger, and index finger receiving portions each have a top panel and a bottom panel, which are connected to form each of the finger receiving portions. An intermediate region of two of the finger receiving portions (ring finger, middle finger) includes a first and second insert. The intermediate region of the other two finger receiving portions (pinky and index fingers) include only a first insert sewn into a bottom panel of the finger receiving portions.

U.S. Pat. No. 4,654,896 to Rinehart discloses a finger portion for a glove where the portion comprises two superimposed four-pointed star-shaped pattern pieces where each star forms a finger part. Each pattern piece has a cut out. The pattern pieces are joined together around their peripheries by sewing or sealing in the flat where the line of juncture of the pieces is along lines of non-extension of the fingers formed by the finger portion. The finger portions of one pattern piece are longer than that of the other pattern piece and the pattern piece having the longer finger part is folded to form a tuck when joined to its corresponding finger part of the other pattern piece.

U.S. Pat. No. 4,245,357 to Connelly discloses a curved gunn-cut glove construction wherein the fingers of the glove curve inwardly towards the palm portion of the glove to conform to the configuration of a hand when in a relaxed state. The palm piece of the glove including the front portions of the first and fourth fingers are joined to a back piece including the back portion of the first, second, third and fourth fingers as well as to a middle piece including the front portions of the second and third fingers.

SUMMARY OF THE INVENTION

In accordance with one aspect of the invention, the pinky is formed of a separate piece of material from the palm portion and ring finger portion of the glove. The pinky is sewn onto the rest of the glove around the base of the pinky. By doing so, the seam that runs along the palm side of one's hand to the sidewall side of the pinky and ring finger is eliminated. In addition, the seams on the sidewalls of the pinky and ring finger that face each other are replaced by a seam at the back or closer to the back of the pinky and ring fingers than the center of the sides of the fingers. In other words, the material that forms the ring finger is wrapped more than halfway around the ring finger so that the seams are near the rear. This eliminates the seam from a high wear area and provides more comfort.

In accordance with another aspect of the invention, optional reinforcing may be sewn onto the pinky and ring finger. On the "conventional" gloves, the reinforcing pad is U-shaped and sewn along its centerline of its length into the finger seams, which appears to be done so that the pad and finger portion of the glove will rest snugly against each other, without slack. This creates a large "ridge" along the inside portion of the glove corresponding to the outside where the centerline seam is.

In this alternate embodiment of the invention, the reinforcing is broken from a U-shape into just the two legs, which are sewn onto the fourth and fifth finger portions, respectfully, around the periphery of the legs. The reinforcing on the fourth finger portion extends, at the "palm" side, a short way onto the palm.

The finger seams for the fourth and fifth finger portions are moved "back" so that the finger portions at the back of the fingers is smaller than the finger portions at the palm side or front side of the fingers. A stretchable fabric may be used at the bottom half of the back of the fourth and fifth finger portions, which extends onto the back of the hand. The top of the back portion of the fourth and fifth finger portions is made of the same material as the remainder of the finger portions (but different from the back of the bottom half).

DESCRIPTION OF THE PREFERRED EMBODIMENT(S)

Figure 1:
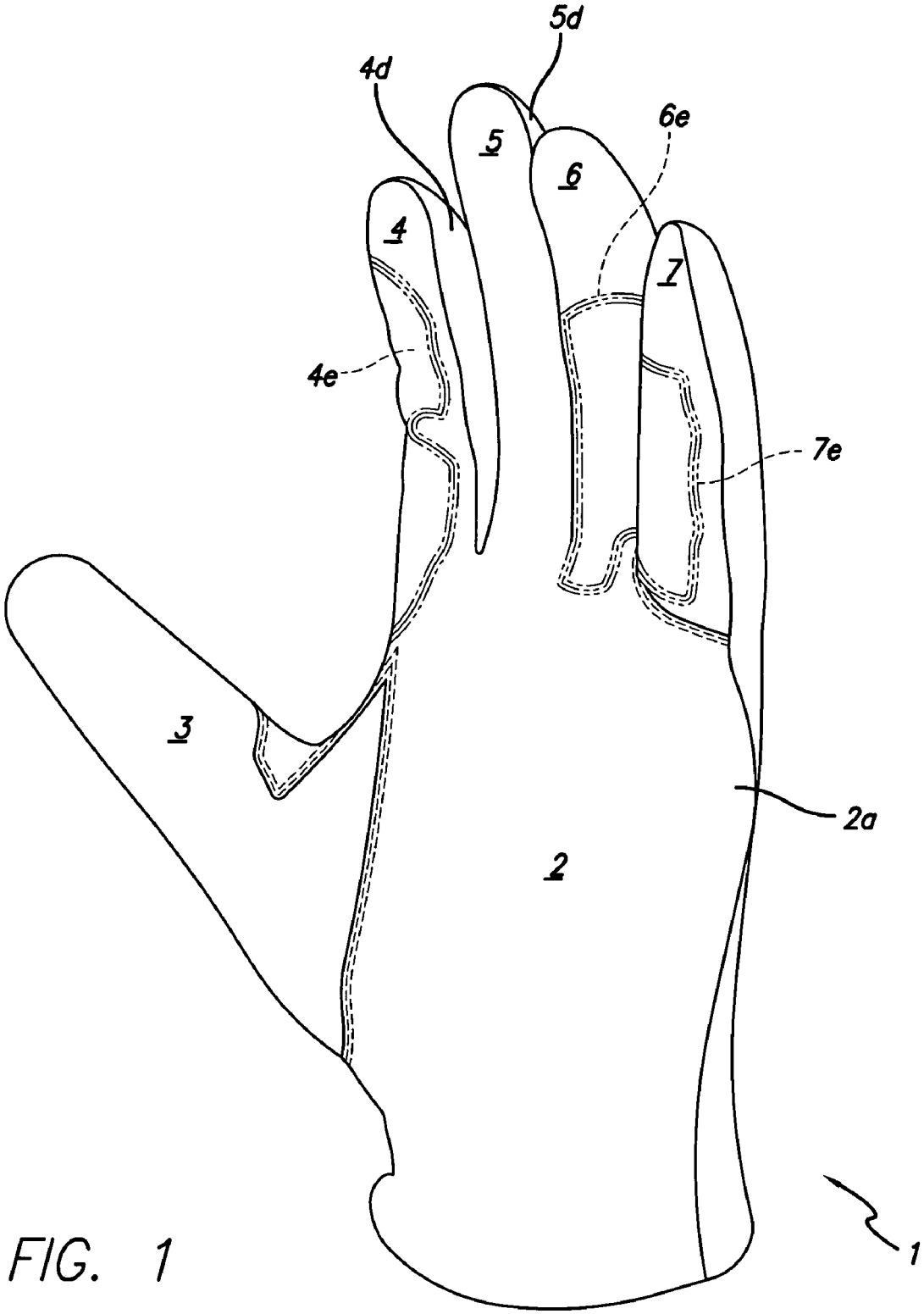
FIG. 1 is a front perspective view of a left glove, with optional reinforcing shown in phantom, in accordance with one embodiment of the invention.
Figure 2:
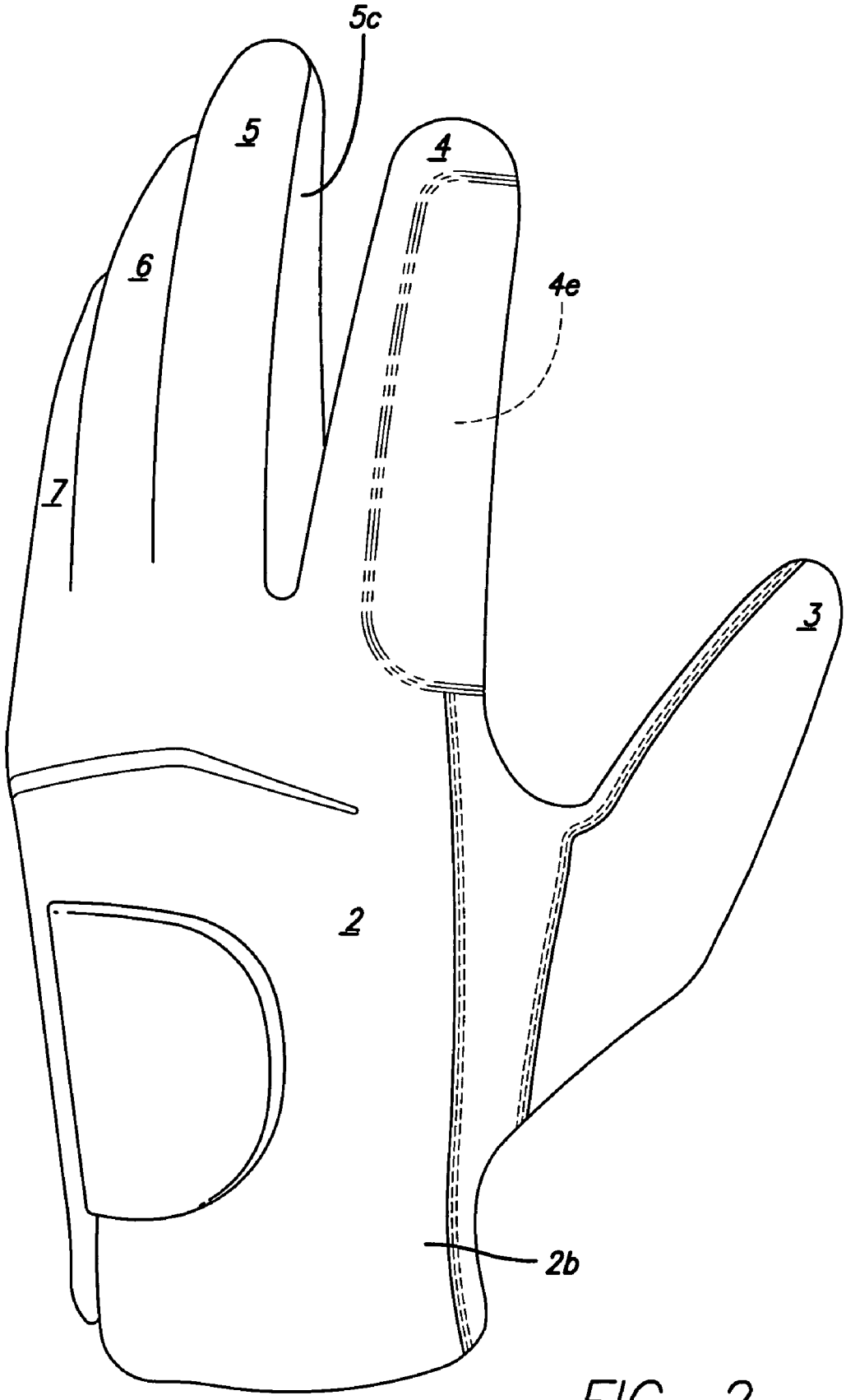
FIG. 2 is a rear elevational view of the glove of FIG. 1 (without showing any perforations)

In accordance with a first embodiment of the invention, a glove 1 has a hand portion 2, a thumb portion 3, a pointer or index finger portion 4, a middle finger portion 5, a ring finger portion 6 and a pinky finger portion 7, as shown in FIGS. 1 and 2. Hand portion 2 has a front or palm portion 2*a* of a first piece of material (FIG. 3) for a front or palm side of a wearer's hand, and a rear or back portion 2*b* of a second piece of material (FIG. 4) for a rear or back side of a wearer's hand. The first and second pieces of material are preferably, but need not be, made of the same material or of a combination of materials. Often the material is leather.

It is noted that the glove and method are being described for a left handed glove, as shown in the drawings. The same glove and method apply to a right handed glove, with the sidewalls reversed.

The first piece of material of front or palm portion 2*a* preferably includes a front portion 4*a* for the pointer or index finger portion 4, a front portion 5*a* for the middle finger portion 5, and a front and left side portion 6*a* for the ring finger portion 6. It may also include a segment 3*c* for the thumb portion 3. The pointer finger portion 4 is made up of not only the front portion 4*a* but also the left side portion 4*d* (to the left of a dashed imaginary border 4*g*) formed unitarily as part of portion 4*a*.

Figure 3:
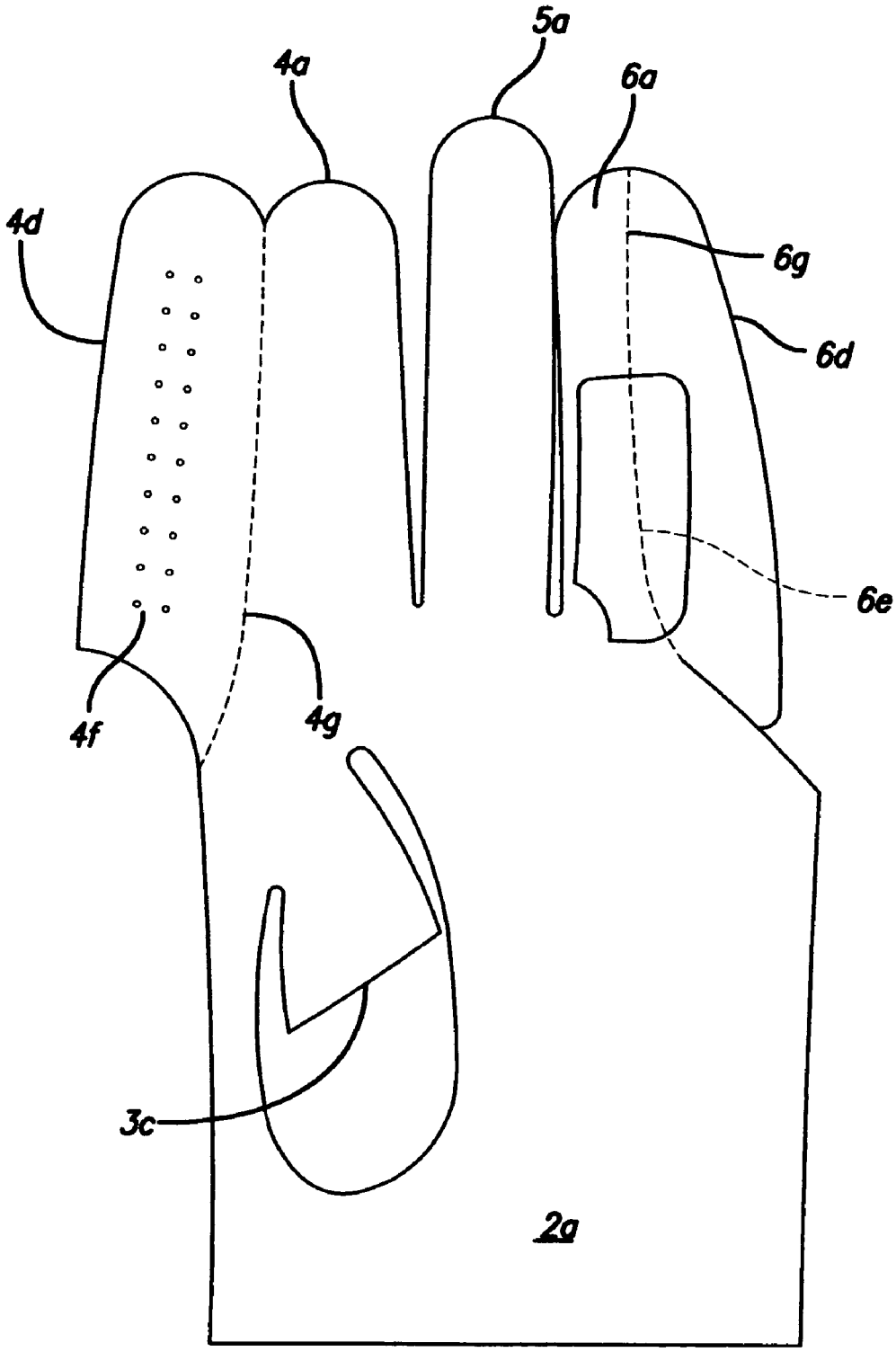
FIG. 3 is a view of a palm portion of the glove of FIG. 1 during assembly.
Figure 4:
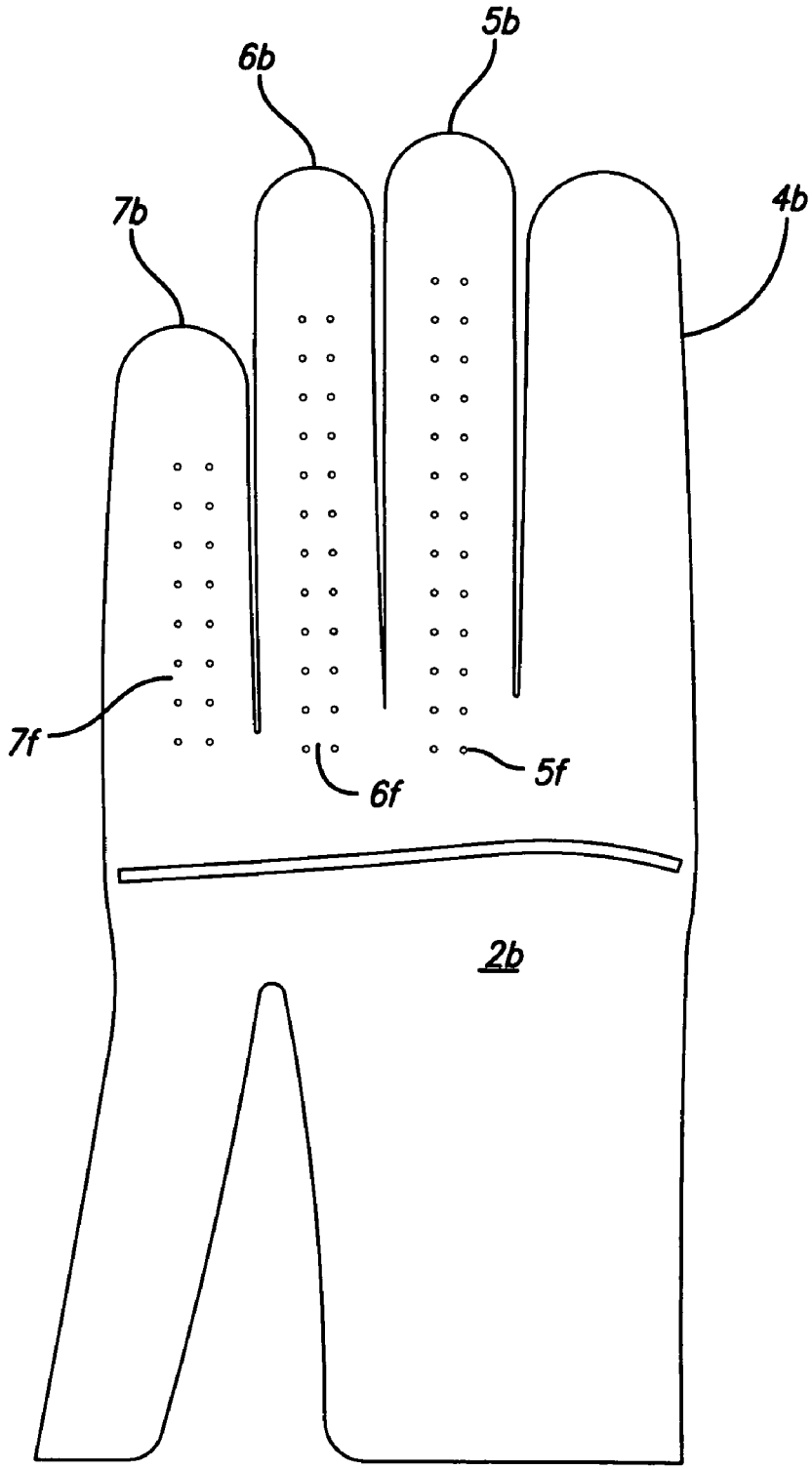
FIG. 4 is a view of a rear portion of the glove of FIG. 1 during assembly.
Figure 5:
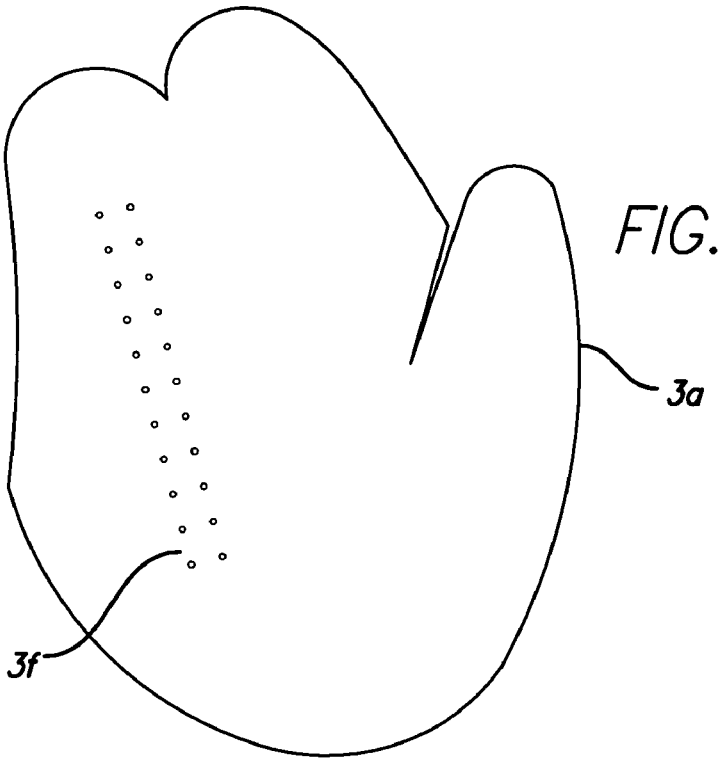
FIG. 5 is a view of a thumb portion of the glove of FIG. 1 during assembly.

The second piece of material of rear or back portion 2*b* preferably includes rear or back pointer or index portion 4*b*, rear or back middle finger portion 5*b*, rear or back ring finger portion 6*b* and rear or back pinky portion 7*b*. Various portions of the finger portions may have perforations as shown by perforations 4*f*, 5*f*, 6*f*, 7*f* and 3*f*, as shown in FIGS. 3-5. Optionally, reinforcing pads 4*e*, 6*e* and 7*e* may be provided and sewn onto the pointer or index finger portion 4, the ring finger portion 6, and/or the pinky portion 7, extending at least part way around the front and sidewalls, e.g., as shown in FIG. 1. The reinforcing may be sewn onto the front and, if desired, at least partly onto the left side portion of the index finger portion, the front and, if desired, at least partly onto the left side portion of the pinky portion and the front and, if desired, at least partly onto the right side portion of the ring finger portion, before further assembly of the finger portions or hand portions.

In this first embodiment, the ring finger portion 6 is made up of not only the front portion 6*a* but also the right side portion 6*d* (to the right of a dashed imaginary border 6*g*) formed unitarily as part of portion 6*a*. Conventionally, the right side portion would be a separate piece of material, and the material used to form side portion 6*d* would be used to form the front portion of the pinky portion.

Figure 11:
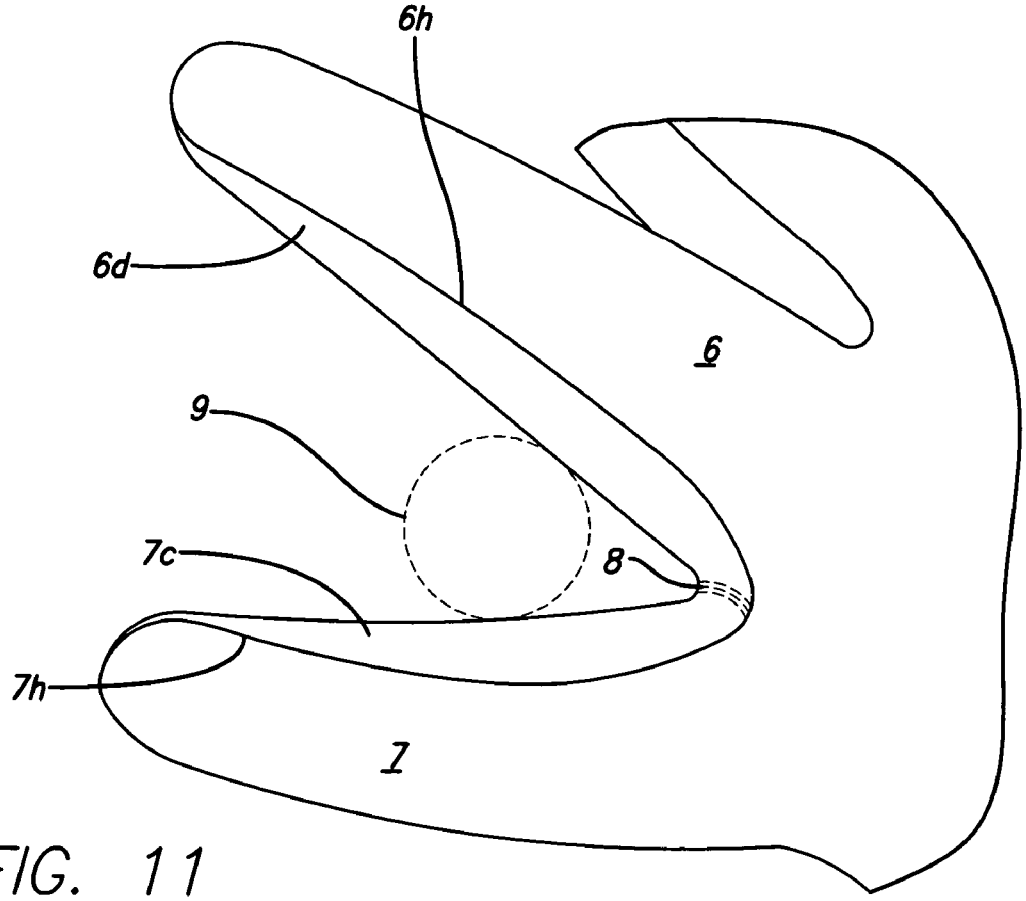
FIG. 11 is a rear perspective view of the pinky and ring finger portions of the glove of FIG. 1 (without reinforcing)
Figure 6:
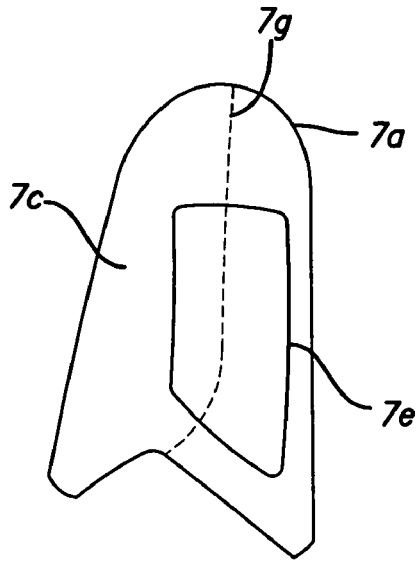
FIG. 6 is a view of a pinky portion of the glove of FIG. 1 during assembly.

Also in accordance with this first embodiment, as shown in FIG. 6, a front portion 7*a* of the pinky portion 7 also includes a left sidewall portion 7*c* (defined by a dashed imaginery border 7*g*) formed unitarily as part of portion 7*a*. Portion 7*a* is formed of a separate piece of material from portion 6*a* By doing this, the left sidewall portion 7*c* of the pinky portion and the right sidewall portion 6*d* of the ring finger portion have no seam running vertically between these sidewall portions and the front portions. The seams are moved to the rear or back of the ring finger and pinky portions for these sidewalls, or at least more than halfway to the back from the front (closer to the back than the front). These seams 6*h* and 7*h* are shown in FIG. 11. The seam 8 passes between the two sidewalls below where reins (shown by a dashed circle 9) may be held.

Figure 7:
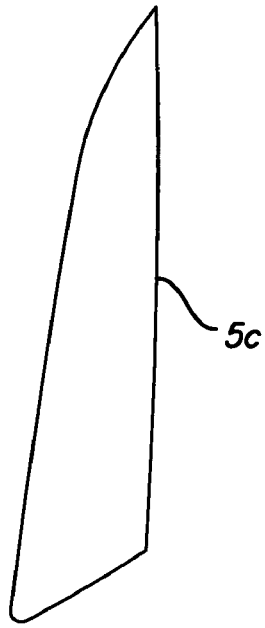
FIG. 7 is a view of a left side portion of the middle finger portion of the glove of FIG. 1 during assembly.
Figure 8:
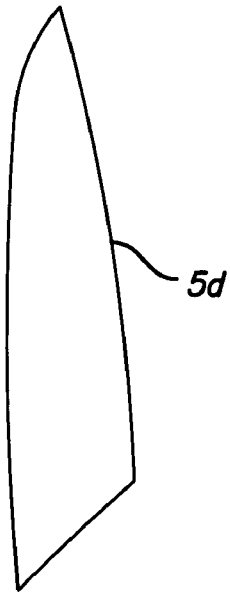
FIG. 8 is a view of a right side portion of a middle finger portion of the glove of FIG. 1 during assembly.
Figure 9:
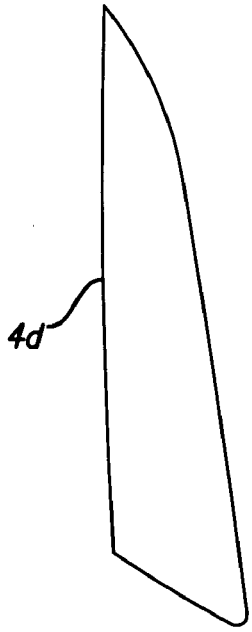
FIG. 9 is a view of a right side portion of a pointer or index finger portion of the glove of FIG. 1 during assembly.
Figure 10:
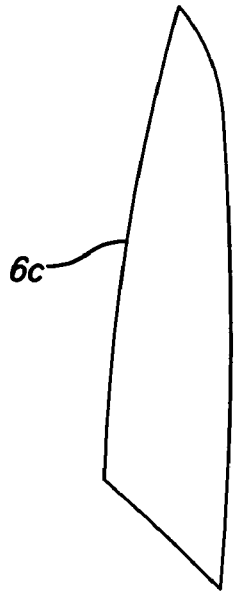
FIG. 10 is a view of a left side portion of a pointer finger portion of the glove of FIG. 1 during assembly.

Left and right sidewall pieces 5*c*, 5*d*, of FIGS. 7 and 8, respectively are sewn to and located between the front and rear pieces 5*a*, 5*b*, as shown in FIGS. 1 and 2. Right sidewall piece 4*d* of FIG. 9 is sewn to and located between the front and rear pieces 4*a*, 4*b*, as shown in FIG. 1. Left sidewall piece 6*c* is sewn to and located between the front and rear pieces 6*a* and 6*b* (piece 6*c* is not visible in FIG. 1 or 2 but is opposite piece 5*d*).

When the glove is assembled, there are no seams between the front portions and facing or opposing sidewall portions of the ring and pinky finger portions. (see FIG. 11) Seam 8 between the two opposing sidewall portions replaces the conventional sidewall seams.

A process of making the glove includes the steps of:

cutting the front piece of one material unitarily including at least a palm portion and the ring finger front and right sidewall portion, and preferably front portions of the middle finger and pointer or index finger, and the thumb side (left for left glove or right for right glove) sidewall portion of the pointer or index finger;

cutting the rear or back piece from a second material preferably including a rear or back portion of the hand and the rear or back portions of each of the fingers (preferably except the thumb);

cutting a front and inner or ring finger facing (left for left glove and right for right glove) sidewall portion of the pinky portion from a third piece of material separate from the first (and second) pieces of material; and cutting any other pieces such as a thumb portion and left and right sidewall portions for the middle finger, middle finger facing (left for left glove and right for right glove) sidewall portion of the ring finger portion, and middle finger facing (right for left glove and left for right glove) sidewall portion of the index or pointer finger portion;

cutting any optional reinforcing portions;

sewing any optional reinforcing portions onto the desired front finger portions;

sewing the front and rear hand portions together, and all the sidewall portions, pinky front and sidewall portions, and thumb portions, together in the locations shown in the drawings.

Figure 12:
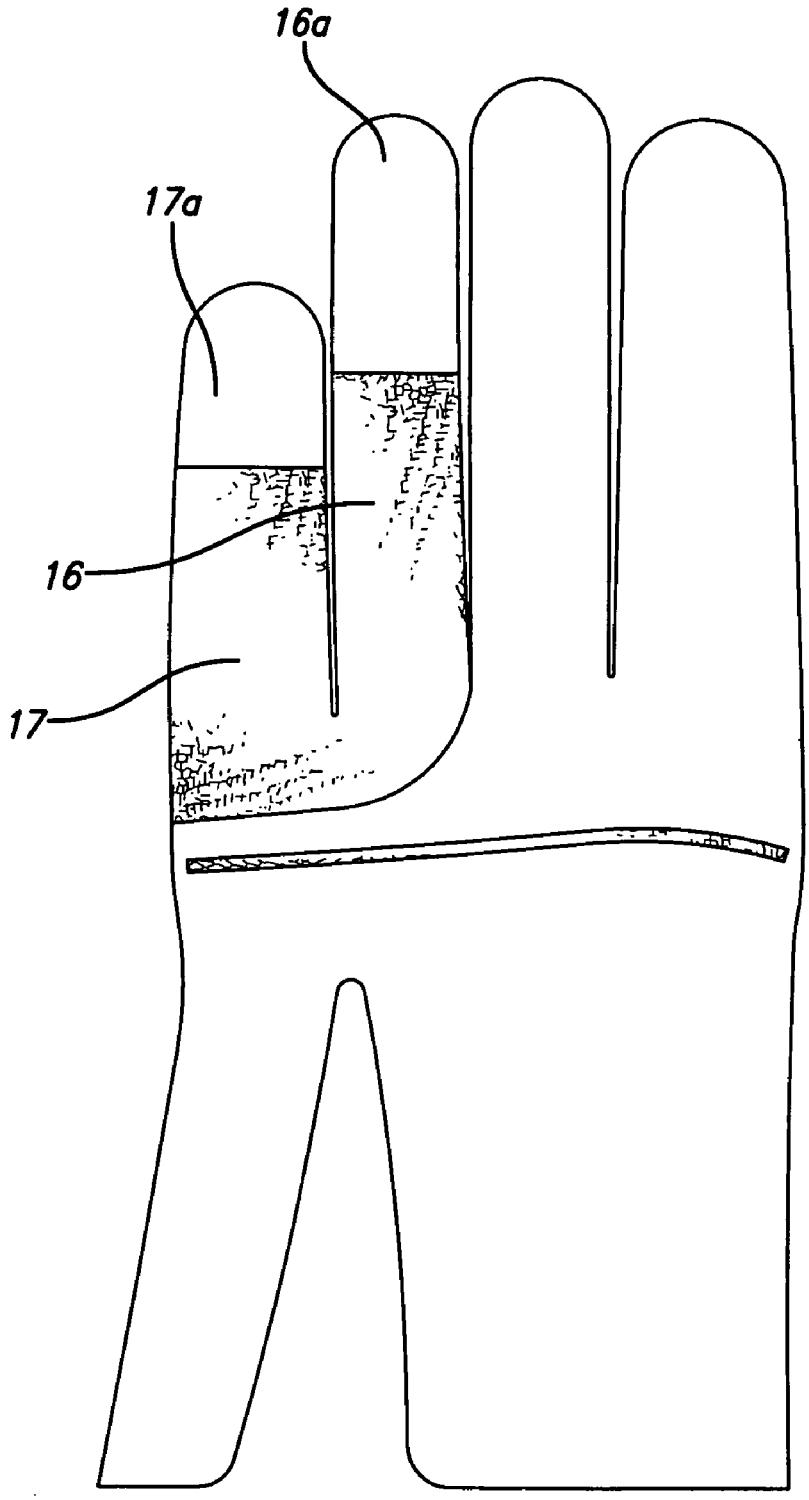
FIG. 12 is a view of a rear portion of a glove of an alternate embodiment.

In another embodiment of the invention as shown in FIG. 12, the rear lower portions of the ring and pinky fingers may each be made of a separate material so the material can be different from the other materials, e.g., a stretchable material 16, 17 and tops 16*a*, 17*a* at the back of the glove may be of the same material as the front. There are seams all around the stretchable material.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part.

What is claimed is:

1. A glove comprising:

a palm portion having a palm area for covering at least a portion of a wearer's palm and at least a front ring finger portion unitary therewith, the front ring finger portion being for covering at least a palm side of a ring finger and a first sidewall thereof;

a back portion having a back area for covering at least a portion of a back of a hand and being fixed to the palm portion; and a separate pinky portion formed of a separate material from the palm portion and back portion, and fixed to the palm portion and back portion pinky for covering at least a palm side of the pinky and an inner sidewall thereof which faces the ring finger portion.

2. The glove of claim 1 wherein the first sidewall of the ring finger portion faces the separate pinky portion.

3. The glove of claim 2 wherein the back portion has a back ring finger portion, and the first sidewall of the front ring finger portion is sewn to the back ring finger portion.

4. The glove of claim 1 wherein the back portion includes a back pinky portion for covering a back of a pinky, wherein the separate pinky portion comprises one piece of material from at least a back of the inner sidewall to a palm side of an outer sidewall of the pinky portion, and wherein the outer sidewall faces away from the ring finger portion.

5. The glove of claim 4 wherein the back pinky portion is unitary with the back portion.

6. The glove of claim 4 wherein the back pinky portion forms the outer sidewall of the pinky portion.

7. The glove of claim 6 wherein the separate pinky portion is sewn to the back pinky portion at a back side edge of the inner sidewall of the separate pinky portion and also sewn to the back pinky portion at a palm side edge of the back pinky portion.

8. The glove of claim 7 wherein there is a second sidewall portion for covering a sidewall of the ring finger portion facing away from the inner sidewall of the pinky portion, and the front ring finger portion is sewn to the second sidewall portion and the second sidewall portion is also sewn to the back ring finger portion.

9. The glove of claim 1 wherein the separate pinky portion is sewn to the back pinky portion, and there is a seam for the separate pinky portion extending between the first sidewall portion of the front ring finger portion and the inner sidewall portion of the separate pinky portion in a direction extending from the palm portion to the back portion.

10. The glove of claim 1 further comprising a reinforcing material sewn onto the front pinky portion and the front ring finger portion.

11. The glove of claim 1 further comprising a thumb portion for covering a thumb and being fixed to the palm portion and back portion, a pointer finger portion fixed to the palm portion and back portion for covering a pointer finger, and a middle finger portion fixed to the palm portion and back portion for covering a middle finger.

12. A method of making a glove, comprising the steps of:

i. forming a palm portion of a first piece of material having a palm area for covering at least a portion of a wearer's palm and at least a front ring finger portion unitary therewith, the front ring finger portion being for covering at least a palm side of a ring finger and a first sidewall thereof;

ii. forming a back portion of a second piece of material having a back area for covering at least a portion of a back of a hand;

iii. forming a separate pinky portion of a third piece of material separate from the palm portion and back portion;

iv. fixing the palm and back portions together; and v. fixing the separate pinky portion, for covering at least a palm side of the pinky and an inner sidewall thereof which faces the ring finger portion, to the back portion, palm portion and first sidewall of the front ring finger portion.

13. The method of claim 12 wherein in the step of forming the back portion, the back portion is formed with a back pinky portion for covering a back of a pinky, wherein in the step of forming the separate pinky portion, the separate pinky portion includes at least the inner sidewall.

14. The method of claim 13 wherein in the step of forming the back pinky portion, the back pinky portion is formed with material for forming the outer sidewall of the pinky portion.

15. The method of claim 13 wherein in the step of fixing the separate pinky portion, the separate pinky portion is sewn to the back pinky portion at a back side edge of the inner sidewall of the separate pinky portion and also sewn to the back pinky portion at a palm side edge of the back pinky portion.

16. The method of claim 13 wherein in the step of fixing the separate pinky portion, a seam is formed extending between the first sidewall of the front ring finger portion and the inner sidewall of the separate pinky portion.

17. The method of claim 12 wherein in the step of forming the back portion, the back portion is formed with a back ring finger portion for covering a back of a ring finger, and wherein in the step of fixing the palm portion to the back portion, the front ring finger portion is sewn to the back ring finger portion along a back edge of the first sidewall of the front ring finger portion.

18. The method of claim 17 wherein there is a step of fixing reinforcing material onto the front ring finger portion and the separate pinky portion.

19. A glove comprising:

a palm portion having a palm area for covering at least a portion of a wearer's palm and at least a front ring finger portion unitary therewith, the front ring finger portion being for covering at least a palm side of a ring finger and a first sidewall thereof;

a back portion having a back area for covering at least a portion of a back of a hand and being fixed to the palm portion;

a back pinky portion for covering a back of a pinky finger, a back ring finger portion for covering a back of a ring finger;

a separate pinky portion formed of a separate material from the palm portion and back portion, and fixed to the palm portion and back pinky portion for covering at least a palm side of the pinky and an inner sidewall thereof which faces the first sidewall of the front ring finger portion, wherein the first sidewall of the ring finger portion faces the separate pinky portion; and a thumb portion for covering a thumb and being fixed to the palm portion and back portion, a pointer finger portion fixed to the palm portion and back portion for covering a pointer finger, and a middle finger portion fixed to the palm portion and back portion for covering a middle finger.

20. The glove of claim 19 wherein the separate pinky portion is sewn to the back pinky portion at a back side edge of the inner sidewall of the separate pinky portion and also sewn to the back pinky portion at a palm side edge of the back pinky portion, and there is a seam for the separate pinky portion extending between the first sidewall portion of the front ring finger portion and the inner sidewall portion of the separate pinky portion in a direction extending from the palm portion to the back portion, and wherein the first sidewall of the front ring finger portion is sewn to the back ring finger portion.

* * * * *